United States Patent [19]

Braconnier et al.

[11] 4,211,812

[45] Jul. 8, 1980

[54] OPENWORK TEXTILE STRUCTURE AND PROCESS FOR MANUFACTURE THEREOF

[75] Inventors: Daniel Braconnier, Ecully; Jean Joly, Craponne; Michele Renault, Venissieux, all of France

[73] Assignee: Rhone-Poulenc-Textile, Lyon, France

[21] Appl. No.: 787,586

[22] Filed: Apr. 14, 1977

[30] Foreign Application Priority Data

Apr. 22, 1976 [FR] France ..... 76 13078

[51] Int. Cl.[2] ..... D03D 3/00

[52] U.S. Cl. ..... 428/224; 428/255; 428/257

[58] Field of Search ..... 29/526 R; 28/145, 146, 28/149, 151, 152; 156/181, 290, 306; 428/194, 195, 198, 224, 131, 137, 247, 257, 171, 255; 289/18 M

[56] References Cited

U.S. PATENT DOCUMENTS

| | | | |
|---|---|---|---|
| 1,446,316 | 2/1923 | Niemiec et al. | 28/152 |
| 2,461,030 | 2/1949 | Breckman | 29/526 |
| 2,464,432 | 3/1949 | Breckman | 29/526 |
| 3,934,633 | 1/1976 | Bula | 152/221 |

*Primary Examiner*—James J. Bell

*Attorney, Agent, or Firm*—Sherman & Shalloway

[57] ABSTRACT

An openwork textile structure is formed from at least one textile web and has a plurality of regularly and/or randomly distributed open areas wherein each open area is separated from the adjacent open area by at least one compressed zone of textile materials contiguous with at least one zone of textile materials having a greater apparent diameter than the compressed zones, and wherein the textile materials of the web remain parallel to one another in the compressed zones. Three-dimensional openwork textile structures can be formed by superimposing two or more of the openwork textile webs and gathering together and compressing in parallel arrangement, textile materials from at least two adjacent superimposed webs.

The openwork textile structures can be prepared by holding a web of crimped textile materials under tension, locally compressing the web at a plurality of locations along the length and width thereof and thereafter relaxing the tension or by holding in place a web of non-crimped, but heat crimpable, textile materials, compressing the web at a plurality of locations along its width and length and thereafter heat treating the web, in the absence of tension, to develop the latent crimps.

The openwork textile structures have various applications as decorative articles, furnishings and clothing.

7 Claims, 2 Drawing Figures

OPENWORK TEXTILE STRUCTURE AND PROCESS FOR MANUFACTURE THEREOF

The present invention relates to openwork structure and its manufacturing process. More particularly, the present invention relates to openwork textile structures which may be either two- or three-dimensional and the process for manufacturing these structures.

Openwork woven fabrics or openwork knitted fabrics made by various mechanical means are known in the art. Openwork or reticulated non-woven fabrics are also known in the art wherein the openings are made, for example, by impinging jets of air in accordance with a defined pattern on a fibrous non-woven web. It is similarly known to manufacture openwork or reticulated fabric structures or knitting by forming the openings by chemical means, such as in a process known as devouring.

According to the present invention, openwork structures are obtained without forming the open areas in the form of mechanical perforations or chemical perforations. Rather, in the openwork structures of the present invention, the openings are formed without any wastage of the textile materials merely by gathering together and bonding permanently or temporarily some of the textile elements of one or several superimposed textile webs at various locations along its width and length.

U.S. Pat. No. 2,074,817 to Bargen relates to a netting needle and illustrates in its FIG. 1 a netted fabric in which a plurality of vertically and horizontally disposed strands of yarns or cords are tied together at their intersections such that each open area is defined by four cross-over points wherein the textile material is highly compressed and four adjoining sides wherein the textile material has a greater apparent diameter than at the cross-over points.

The openwork fabric textile structure of the present invention differs from the netted fabric structure described by Bargen in that at the compressed zones of the structure all of the textile materials are parallel to each other.

The openwork textile structure of the present invention has a plurality of open areas, each open area being separated from the immediately adjacent open area by at least one compressed textile zone contiguous with at least one textile zone of greater apparent diameter, the structure being formed from at least one textile web having a plurality of open areas distributed over its surface wherein in the compressed zones the textile materials forming the textile web are parallel to each other. Moreover, in a preferred embodiment, the textile materials in each compressed zone are substantially parallel to the textile materials in at least a majority and preferably all of the remaining compressed zones.

The compressed zones are preferably permanently formed such as by the use of an adhesive or by heat or solvent welding or fusing the textile materials by conventional means. The compressed zones may also be held in place by such permanent or temporary devices as ties, rings, hooks, hoops, and tubes of any length and any configuration. These compressing means may be made from any suitable material including, such as textile, metal, wood, plastic, paper, leather and the like. Further, these compressing or pinching devices can be fixed in place such as by a crimping tool or can be arranged for sliding over the gathered textile materials.

The fibrous webs from which the openwork textile structures of the present invention are formed can be made from cut fibers such as, for example, card voiles having sufficient cohesion to be substantially self-supporting. The fibrous webs may also be made from natural and/or synthetic continuous filament tows. Further, the fibrous webs may be formed by combining bands of fibers together such as card bands or unstretched bands of continuous yarns.

In general, the textile materials forming the webs from which the openwork structures of the present invention are formed can be in the form of fibers, continuous yarns, spun yarns (single or twisted) or bandeaux which may be used alone or in combinations with one another. Furthermore, the textile materials may be either pneumatically or mechanically crimped or may be of the type having a latent heat-developable crimp which can be developed by heat-treatment.

When the openwork structure is formed from textile webs formed from pneumatically or mechanically crimped textile materials at least one web of the crimped textile materials is held under tension in the longitudinal direction, the textile material forming the web is compressed at a plurality of positions along the length and width of the web to form a plurality of open areas, each open area being defined by at least one compressed zone and at least one non-compressed zone, and the tension is then released.

The present invention also provides a process for producing openwork textile structure from textile webs of non-crimped, heat-crimpable textile materials. According to this embodiment of the process of the present invention at least one web of non-crimped, heat-crimpable textile material is held in place and the textile material forming the web is compressed at a plurality of positions along the length and width of the web to form a plurality of open areas, each area defined by at least one compressed zone and at least one non-compressed zone, and thereafter, the web is heat-treated to develop the latent crimps. In this embodiment, the web is not kept under tension during either the compressing step or during the heat-treating step.

The compressed zones may be made by gathering together the textile materials forming the web or superimposed webs either at uniformly spaced intervals along the width and length of the structure or at random intervals along the length and/or width of the structure. Alternatively, it is possible to form the compressed zones such that at one or more portions of the fabric the compressed zones, and consequently the open areas, are regularly distributed over the width and length of the fabric and at another portion or portions of the structure, the compressed zones, and consequently the open areas, are randomly distributed over the length and/or width of the structure.

When the openwork textile structures are formed from a plurality of superimposed textile webs, the webs may be superimposed such that the fibers or yarns of each web are disposed in the same direction or at an angle to each other. By varying the number of webs, it is possible to obtain openwork structures having varying thicknesses. Moreover, by gathering together the textile materials throughout the thickness of the plurality of superimposed webs to form the compressed zones as well as by forming compressed zones within only a single web and from several adjacent webs, but less than the total number of superimposed webs, it is possible to form very decorative three-dimensional openwork textile structures.

Similarly, three-dimensional openwork textile structures can be formed by combining two or more two-dimensional openwork textile structures formed according to the procedures according to the present invention by securing two or more of the two-dimensional openwork textile structures to each other at a plurality of compressed zones such that each of the compressed zones contains parallel textile materials taken from the textile zones of greater apparent diameter of each of at least two adjacent two-dimensional openwork textile structures.

In order to obtain still additional variety in the openwork textile structure, the textile webs or bands from which the openwork textile structures are formed as well as the compressing devices may be made of various colors. It is also possible to provide printing on the webs either before or after forming into the openwork structure.

The two-dimensional or three-dimensional openwork textile structures according to the present invention have various applications for decorations, furnishings, clothing and the like. For example, the structures may be used to make curtains, hangings, wall tapestries, ceiling decorations, bed-spreads or for lined or unlined clothing. The openwork structures may also be lined when used in the preparation of furnishings or decorations.

BRIEF DESCRIPTION OF THE DRAWINGS

The following

As seen in FIG. 1, the open areas 1 are defined by at least one compressed zone 2 and at least one textile zone of larger apparent diameter 3. In this case, the compressed zones 2 are pinched together by colored rings. As seen in the figure, the openwork textile structures permit wide variations in location of the open areas. At the upper and lower portions of the structure, the open areas are relatively regularly distributed along the width and length, while at the middle portion the open areas are more irregularly distributed. In this regard, it will further be seen that it is possible to have only a single textile zone of larger apparent diameter emanating from a single compressed zone or as many as three or more textile zones of larger apparent diameter emanating from a single compressed zone.

It is further apparent that the number and arrangement of the compressed zones can be simply selected to provide as large or as small dimensions of the open areas as desired.

Figure 1:
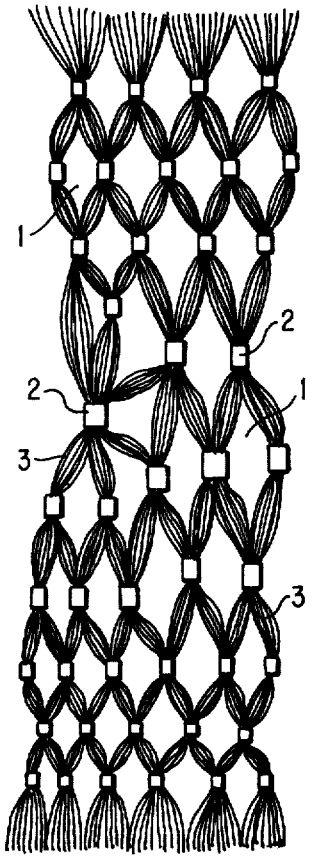
FIG. 1 illustrates one form of a two-dimensional openwork textile structure prepared by the process of the present invention.
Figure 2:
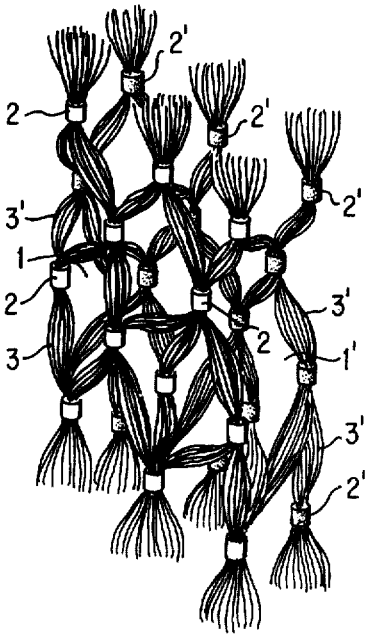
FIG. 2 illustrates a three-dimensional openwork textile structure.

FIG. 2 illustrates how two of the pre-formed openwork textile structures such as shown in FIG. 1 can be combined to form a three-dimensional structure by grasping together in compressed zones portions of the textile zones of larger apparent diameter from each of the two-dimensional structures.

The following example illustrates the present application without in any manner limiting it.

EXAMPLE

A tow made from polyhexamethylene adipamide filaments, 2,000,000 dtex of 20 dtex per strand is crimped using a fluid texturing device having a rectangular section injector and nozzle in accordance with the process described in U.S. Pat. No. 3,373,470 (fluid:-stream supplied at a pressure of 6 kg/cm$^2$, supply speed for the tow: 50 meters/minute). The tow, after crimping, is spread out by known means to provide a textile web. The web is placed under tension, compressed zones are formed both randomly and regularly by means of colored rings, such as the type used for ringing birds, and the tension is thereafter removed. The resulting openwork textile structure has a configuration similar to that shown in FIG. 1. This openwork structure can be used, for example, as a wall hanging or as a partition between two rooms in a dwelling.

While there have been shown and described particular embodiments of the invention, it will be obvious to those skilled in the art that various changes and modifications may be made therein without departing from the invention, and, therefore, it is aimed to cover all such changes and modifications as fall within the true spirit and scope of the invention.

What is claimed is:

1. In an openwork bulky, decorative textile structure in which each open area is separated from the immediately adjacent open area by at least one compressed textile zone contiguous with at least one textile zone of greater apparent diameter, the improvement comprising, said textile structure formed from a plurality of textile webs having a plurality of open areas distributed over its surface wherein in the compressed zones the textile materials forming the textile webs are parallel to each other.

2. The openwork textile structure of claim 1 wherein the textile materials in a compressed zone are substantially parallel to the textile materials in at least a majority of the remaining compressed zones.

3. A three-dimensional openwork textile structure comprising at least two two-dimensional openwork textile structures, each two-dimensional openwork textile structure formed from at least one textile web and including a plurality of open areas distributed over its surface, each open area defined by at least one compressed zone of the textile materials forming the at least one textile web, wherein in each compressed zone the textile materials are parallel to each other, and by at least one zone of said textile materials which has a greater apparent diameter, and wherein the at least two two-dimensional openwork textile structures are secured to each other at a plurality of compressed zones containing parallel textile materials from each of at least two adjacent two-dimensional openwork textile structures.

4. A three-dimensional openwork textile structure comprising:

a plurality of textile webs superimposed one upon another, a plurality of open areas distributed over the surface and throughout the thickness of the plurality of textile webs, each open area defined by, at least one compressed zone of textile material from one or more of the plurality of textile webs, at least some of the compressed zones being formed from the textile materials of less than the total number of superimposed webs, and at least one zone of textile materials which has a greater apparent diameter, wherein in each compressed zone the textile materials are parallel to each other.

5. The openwork textile structure of claim 1, in which each textile web is formed from cut fibers.

6. The openwork textile structure of claim 1, in which each textile web is formed from continuous filaments.

7. The openwork textile structure of claim 1, in which each textile web is formed from bands arranged side by side.

* * * * *